US006568034B2

(12) United States Patent
Cho

(10) Patent No.: US 6,568,034 B2
(45) Date of Patent: May 27, 2003

(54) HINGE ASSEMBLY

(75) Inventor: Gyu Yeol Cho, Kyongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/881,010

(22) Filed: Jun. 15, 2001

(65) Prior Publication Data

US 2001/0052167 A1 Dec. 20, 2001

(30) Foreign Application Priority Data

Jun. 20, 2000 (KR) ..... 2000-33932

(51) Int. Cl.[7] ..... E05D 11/08; E05C 17/64
(52) U.S. Cl. ..... 16/337; 16/340; 361/681
(58) Field of Search ..... 16/337, 340; 361/680, 361/681, 682, 683

(56) References Cited

U.S. PATENT DOCUMENTS 5,022,778 A * 6/1991 Lu ..... 16/273
5,208,944 A * 5/1993 Lu ..... 16/278
5,239,731 A * 8/1993 Lu ..... 16/340
5,894,633 A * 4/1999 Kaneko ..... 16/306
5,913,351 A * 6/1999 Miura ..... 16/340
5,970,580 A * 10/1999 Katoh ..... 16/337
6,108,868 A * 8/2000 Lin ..... 16/327
6,154,925 A * 12/2000 Miura ..... 16/338
6,171,011 B1 * 1/2001 Wu ..... 16/337
6,378,171 B1 * 4/2002 Suzuki et al. ..... 16/342

* cited by examiner

*Primary Examiner*—Thomas B. Will
*Assistant Examiner*—Alexandra K. Pechhold
(74) *Attorney, Agent, or Firm*—Jacobson Holman PLLC

(57) ABSTRACT

Hinge assembly provided between a fixed body to be coupled to a fixed object and a rotating body to be coupled to a rotating object to be rotatably fitted to the fixed object, for providing a torque required with respect to the fixed object. Hinge assembly includes a shaft, a fixed bracket having one leaf fixed to an end of the shaft, and the other leaf fixed to the fixed body, a rotating bracket having one leaf rotatably coupled to the shaft from an outer side of the fixed bracket, and the other leaf coupled to the rotating body, and a frictional elastic member disposed between the fixed bracket and the rotating bracket such that one end thereof is fixed to an end of the shaft, and the other end thereof coupled to the rotating bracket to pass through the rotating bracket, for making friction as a part of the frictional elastic member in contact with the rotating bracket makes an elastic compression onto the rotating bracket, for applying a torque to the rotating bracket.

24 Claims, 6 Drawing Sheets

HINGE ASSEMBLY

BACKGROUND OF THE INVENTION

1. Field of the Invention

The present invention relates to a hinge assembly, and more particularly, to a hinge assembly, in which an elastic specific body is provided between a fixed body and a rotating body, for exerting a torque to the rotating body.

2. Background of the Related Art

In general, the hinge assembly is used in many fields and different purposes, and, particularly, used widely in computers with monitors which present an image for visual understanding of a product, or in apparatuses which require testing devices and rotating bodies, for adjustment of tilting angles of the monitors or the rotating bodies to meet an angle a user desires.

As an exemplary case, a related art hinge assembly provided to the monitor will be explained, briefly. There are the rotating body coupled with the monitor, the fixed body coupled to a support for supporting the monitor, and friction means provided between the rotating body and the fixed body having various washers and springs for applying a torque to the rotating body.

That is, referring to FIG. 1, there is a fixed bracket 1 corresponding to the fixed body, and a rotating bracket 2 coupled with a shaft 3 for rotating on the shaft 3 coupled to the fixed bracket 1. The rotating bracket 2 corresponds to the rotating body generally provided at a rear of the rotating body, such as the monitor.

Each of the shafts 3 fixed to opposite sides of the fixed bracket 1 is provided with a spring 4 both ends of which are caught at terminals on a side each of the rotating bracket 2 and the fixed bracket 1, for transmission of friction and torque to the rotating bracket 2. There are a rotating angle limiting washer 5 and an oil washer 6 fitted to a round bar projected from the shaft 3, with the rotating bracket 2 fitted thereto in contact with the oil washer 6, and, in succession, another oil washer and a separate tension washer 7 fitted thereto, additionally. Then, a fixing ring 8 is inserted in an end of the shaft 3 projected out of the tension washer 7, and pressed toward the rotating bracket 2 to cause a friction between components fitted between the rotating bracket 2 and the fixed bracket 1, to apply a torque to the rotating bracket 2.

Referring to FIG. 2, in a state an adequate torque required for the hinge assembly structured thus is provided, an impact is given to an end of the shaft 3, to deform a cylindrical edge of the end on a surface of the fixed ring 8 to press down the fixed ring 8, which are finally subjected to caulking to assemble the hinge assembly, permanently.

However, because the hinge assembly is assembled by deformation of the end of shaft caused by impact, the torque applied to the hinge assembly can not be re-set once the hinge assembly is completed. Moreover, the different surfaces of many components involved in providing the friction make adjustment of the friction to an appropriate level is difficult, to require provision of additional washers, that makes the structure substantially complicate. The many components make a productivity of the hinge assembly poor, and to cost high.

SUMMARY OF THE INVENTION

Accordingly, the present invention is directed to a hinge assembly that substantially obviates one or more of the problems due to limitations and disadvantages of the related art.

An object of the present invention is to provide a hinge assembly, in which a friction between a fixed body and a rotating body can be adjusted, a torque of the rotating body can be re-set, and a number of components can be reduced.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the hinge assembly provided between a fixed body to be coupled to a fixed object and a rotating body to be coupled to a rotating object to be rotatably fitted to the fixed object, for providing a torque required with respect to the fixed object, including a shaft, a fixed bracket having one leaf fixed to an end of the shaft, and the other leaf fixed to the fixed body, a rotating bracket having one leaf rotatably coupled to the shaft from an outer side of the fixed bracket, and the other leaf coupled to the rotating body, and a frictional elastic member disposed between the fixed bracket and the rotating bracket such that one end thereof is fixed to an end of the shaft, and the other end thereof coupled to the rotating bracket to pass through the rotating bracket, for making friction as a part of the frictional elastic member in contact with the rotating bracket makes an elastic compression onto the rotating bracket, for applying a torque to the rotating bracket.

The fixed object is a monitor support and the rotating object is a flat monitor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
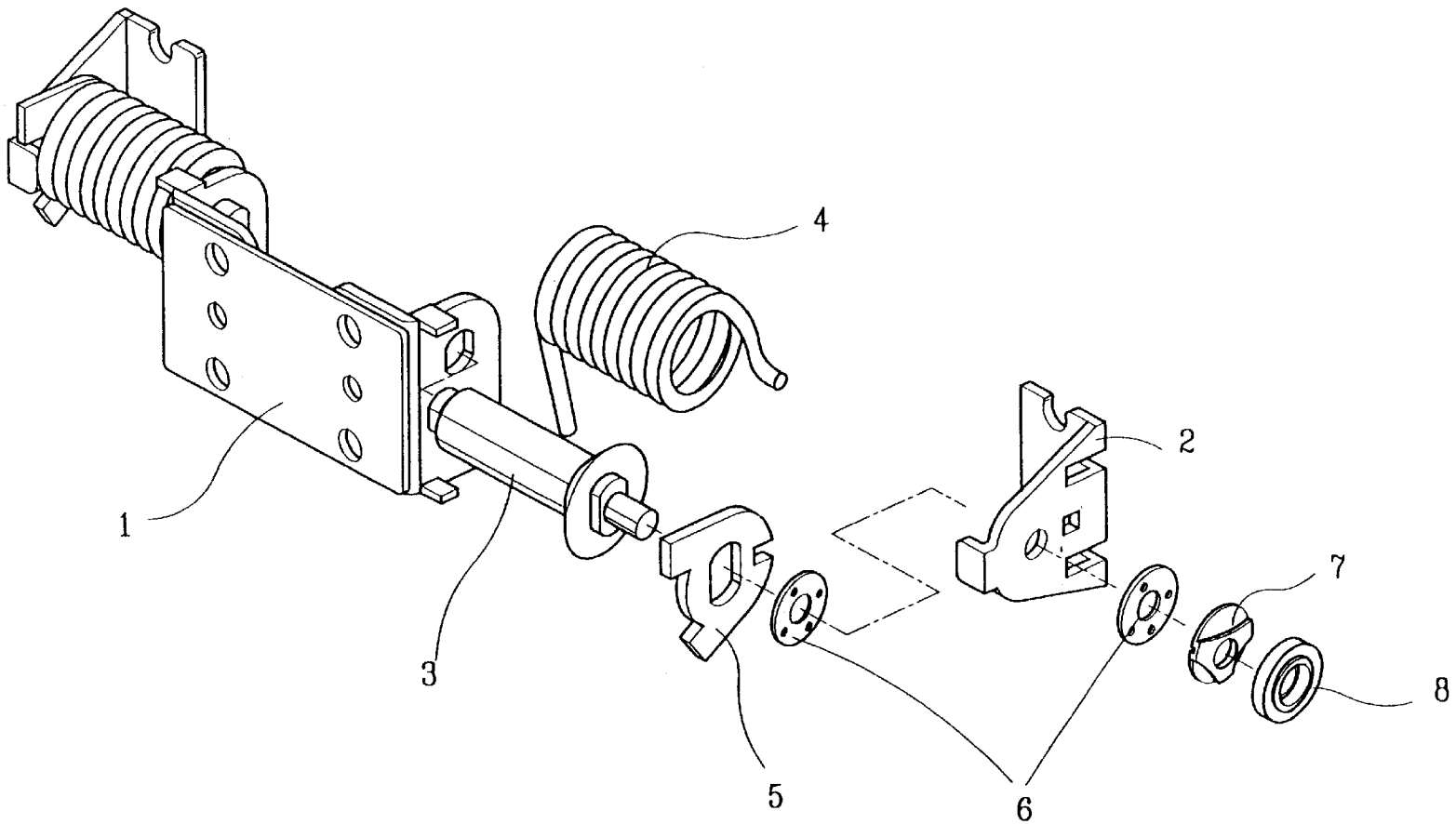
FIG.1 Related Art
FIG. 1 illustrates a perspective view of a related art hinge assembly.
Figure 2:
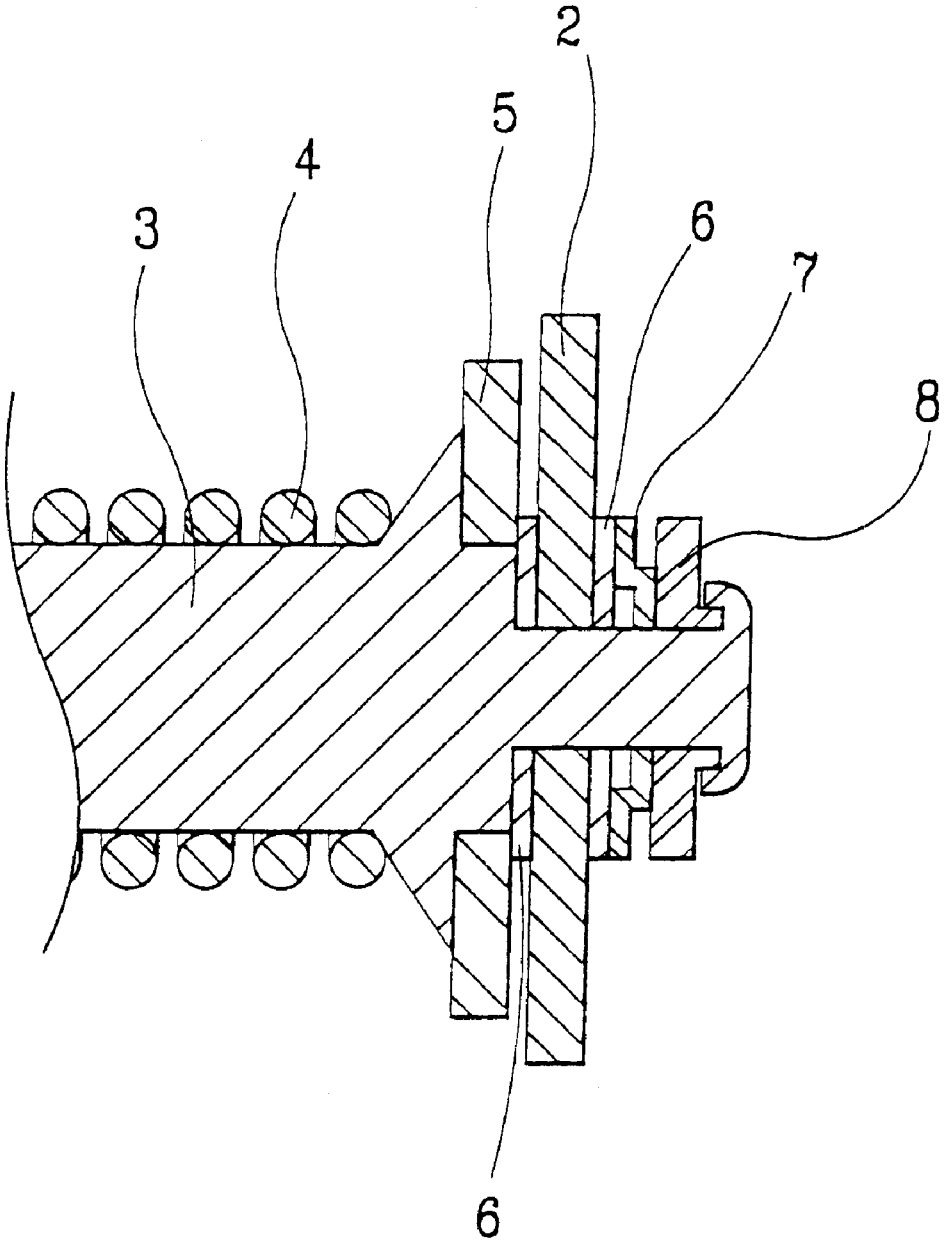
FIG. 2 Related Art
FIG. 2 illustrates a partial section of the related art hinge assembly in FIG. 1.
Figure 3:
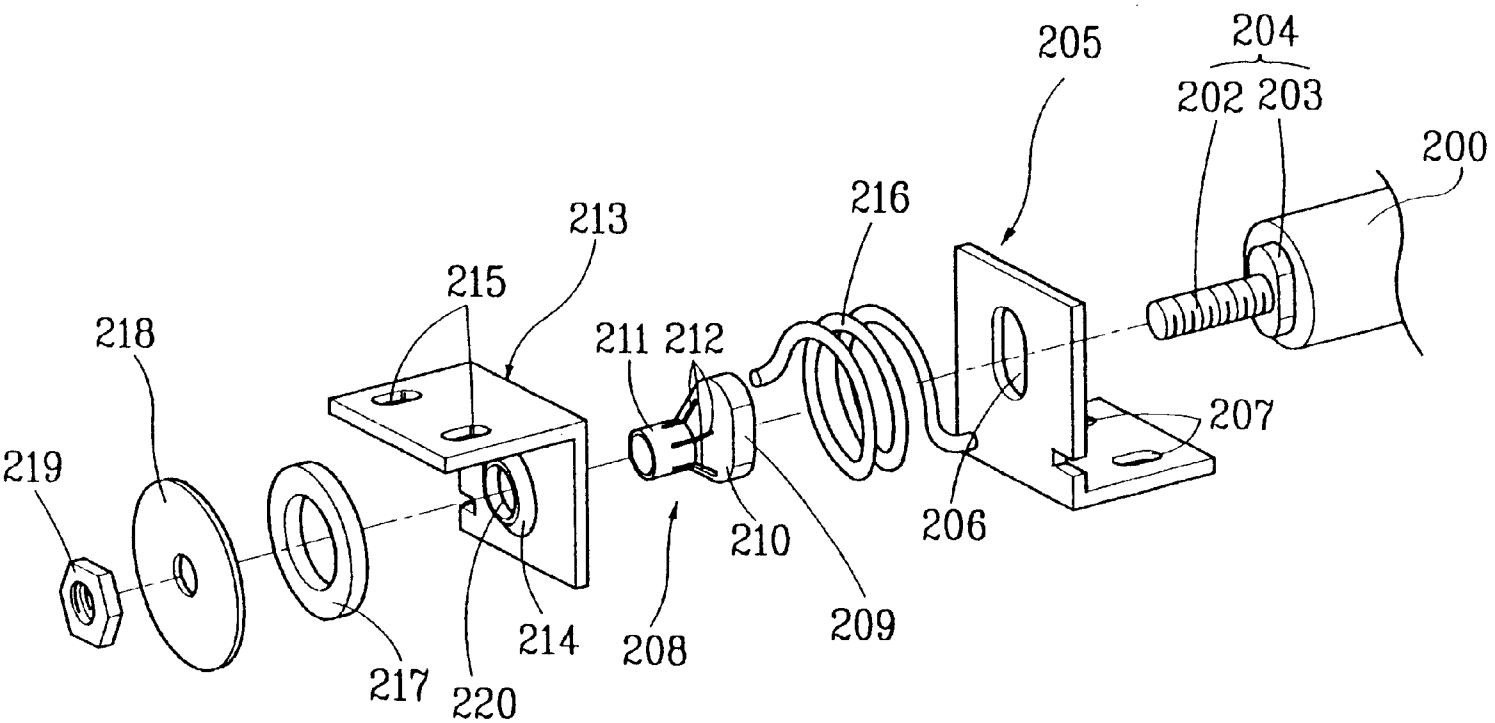
FIG. 3 illustrates a perspective partial assembly view of a hinge assembly in accordance with a first preferred embodiment of the present invention.

Reference will now be made in detail to the preferred embodiments of the present invention, examples of which are illustrated in the accompanying drawings. FIG. 3 illustrates a perspective partial assembly view of a hinge assembly in accordance with a first preferred embodiment of the present invention, and FIG. 4 illustrates a section of key parts of the hinge assembly in FIG. 3.

Figure 4:
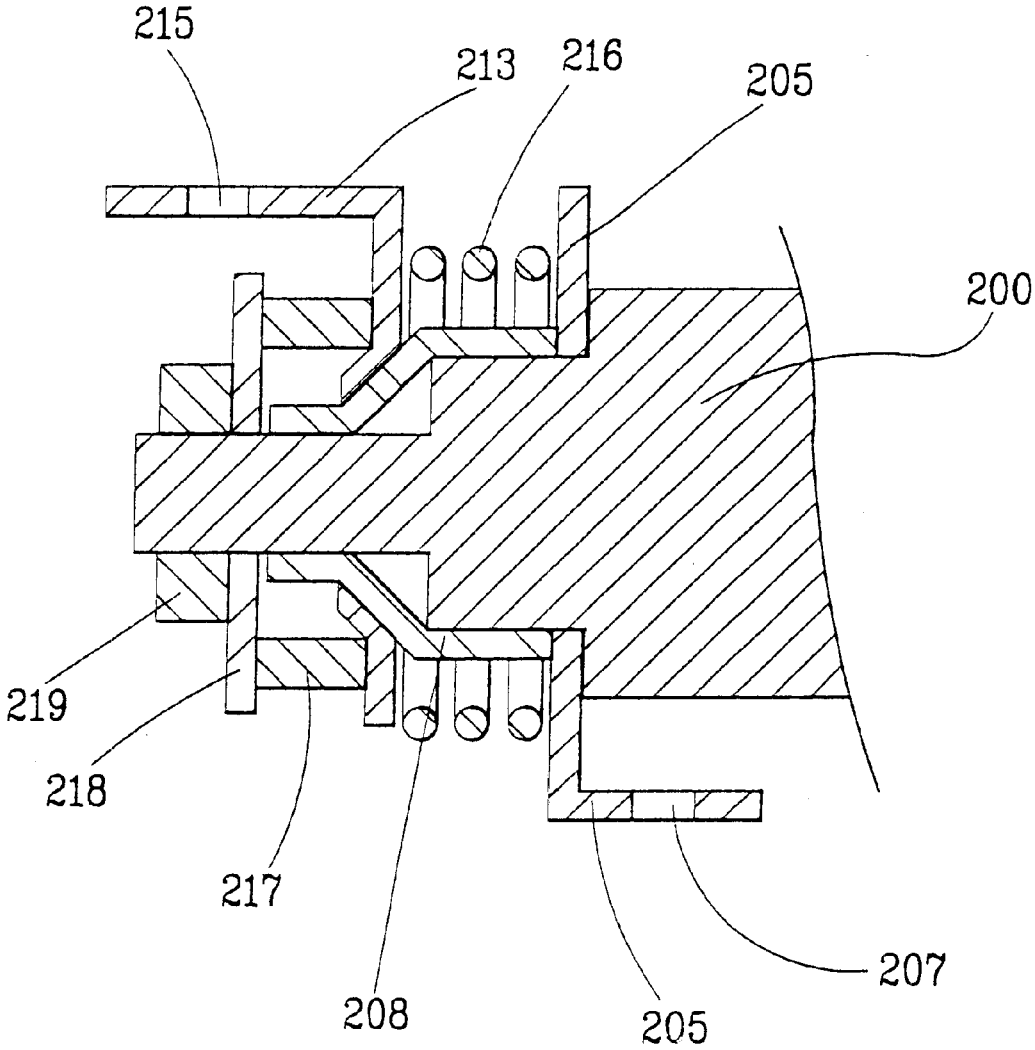
FIG. 4 illustrates a section of key parts of the hinge assembly in FIG. 3.

Referring to FIGS. 3 and 4, the hinge assembly in accordance with a first preferred embodiment of the present invention includes various components of the hinge assembly coupled through each of shafts 200 each having a two stepped cylindrical coupling part 204 with different diameters on one end thereof The two stepped cylindrical coupling part 204 has a lower step 203 with a sectional area smaller than a sectional area of the shaft 200. The lower step 203 has a section having a form, not at least circular, but preferably vertically or horizontally elongated polygonal. Or alternatively, the lower step 203 of the two stepped cylindrical coupling part 204 may be oval.

An upper step 202 next to the lower step 203 has a diameter smaller than the lower step 203, and a thread around the circumference. A fixed bracket 205 having a coupling hole 206 of a form identical to a section of the lower step 203 of the coupling part 204 is coupled to the lower step 202, such that the fixed bracket 205 is not rotatable on the lower step 202 as corners both of the lower step 203 and the coupling holes interfere rotation. The fixed bracket 205 has an 'L' form on the whole, with elongated holes 207 in a surface other than the surface with the coupling hole 206 for insertion of fastening means thereto, such as bolts, to fasten to a fixing body provided for fixing the fixing bracket 205.

After the fixed bracket 205 is coupled to the lower step 203, a frictional elastic member 208, opened in front and rear direction, is fitted to the lower step 203 to surround the lower step 203, such that the frictional elastic member 208 is fixed to the lower step 203 without rotation like the fixed bracket 205 as a bottom part 209 of the frictional elastic coupling 208 is formed to fit to the lower step 203 of the coupling part 204. An overall form of the frictional elastic member 208 has a sloped surface part 210 extended from the bottom part 209 having a diameter decreases continuously as it goes upward, and a cylindrical top part 211 extended from an end of the sloped surface part 210, to form a conical formed in overall.

There is an 'L' rotating bracket 213 in contact with an outside surface of the frictional elastic member 208 fixed to the two stepped coupling part 204 for coupling with a rotating body, having a coupling hole 220 for inserting an upper part 211 of the frictional elastic member 208, and elongated holes 215 for inserting fastening means, such as bolts, therein on the other leaf of the 'L' rotating bracket 213 without the coupling hole 220. The coupling hole 220 in the rotating bracket 213 has a taper part 214 around the coupling hole 220 having a diameter formed gradually smaller, for making a close contact with the sloped surface part 210 of the frictional elastic member 208.

When the rotating bracket 213 is coupled, and compressed on an outside of the frictional elastic member 208, the frictional elastic member 208 is compressed for some extent, such that the frictional elastic member 208 presses a back surface of the taper part 214 around the coupling hole 220 of the rotating bracket 213 by its own elastic force, and causes friction when the rotating bracket 213 is rotated that provides a torque to the rotating bracket 213.

Therefore, grooves or openings 212 are formed in a surface of the frictional elastic member 208 longitudinally for adjusting an elastic deformation, i.e., shrinkage, of the frictional elastic member 208 required for the frictional elastic member 208 according to a shape and weight of the rotating body rotated together with the rotating bracket 213 coupled to the frictional elastic member 208. That is, the grooves or openings 212 are provided for prevention of breakage of the frictional elastic member 208 by excessive compression.

In the meantime, grooves (not shown) with oil stored therein may be formed in a part of the sloped surface part 210 of the frictional elastic member 208 for preventing damage to the surface of the frictional elastic member 208 and making the rotation of the rotating bracket 213 smooth during rotation of the rotating bracket 213 as the rotating bracket 213 makes friction with the surface of the frictional elastic member 208.

When weight on the rotating bracket 213 is substantially great, a torsion spring is provided outside of the frictional elastic member 208 between the rotating bracket 213 and the fixed bracket 205 as means for supplementing the frictional elastic member 208 by increasing the torque provided to the rotating bracket 213. The rotating bracket 215 and the fixed bracket 205 have slots at opposite corners thereof for catching both ends of the torsion spring, so that the torsion spring 216 can provide an elastic force without rotating together with the rotating bracket 213.

In the meantime, referring to FIG. 4, when the rotating bracket 213 and the frictional elastic member 208 are compressed, the cylindrical top part 211 of the frictional elastic member 208 is projected from the coupling hole 220 in the rotating bracket 213. In this instance, since the top of the elastic member 208 can be damaged by an anti-loose nut 219 coupled to an outside of the rotating bracket 213, a separate washer is provided between the anti-loose nut 219 and the rotating bracket 213, additionally. At first, a thick washer 217 having a height as high as the cylindrical top part 211 of the frictional elastic member 208 projected from the coupling hole 220 of the rotating bracket 213 is coupled to the coupling part 204 next to the rotating bracket 213. Then, a washer 218 having a hole large enough for the top end 202 of the coupling part 204 to be inserted therethrough is provided between the thick washer 217 and the anti-loose nut 219. The anti-loose nut 219 presses the hinge assembly from outside, to prevent different components of the hinge assembly from falling off the shaft 200, and an elastic ring of, such as rubber, is inserted at a back surface of the nut 219, for preventing automatic loosening.

Figure 5:
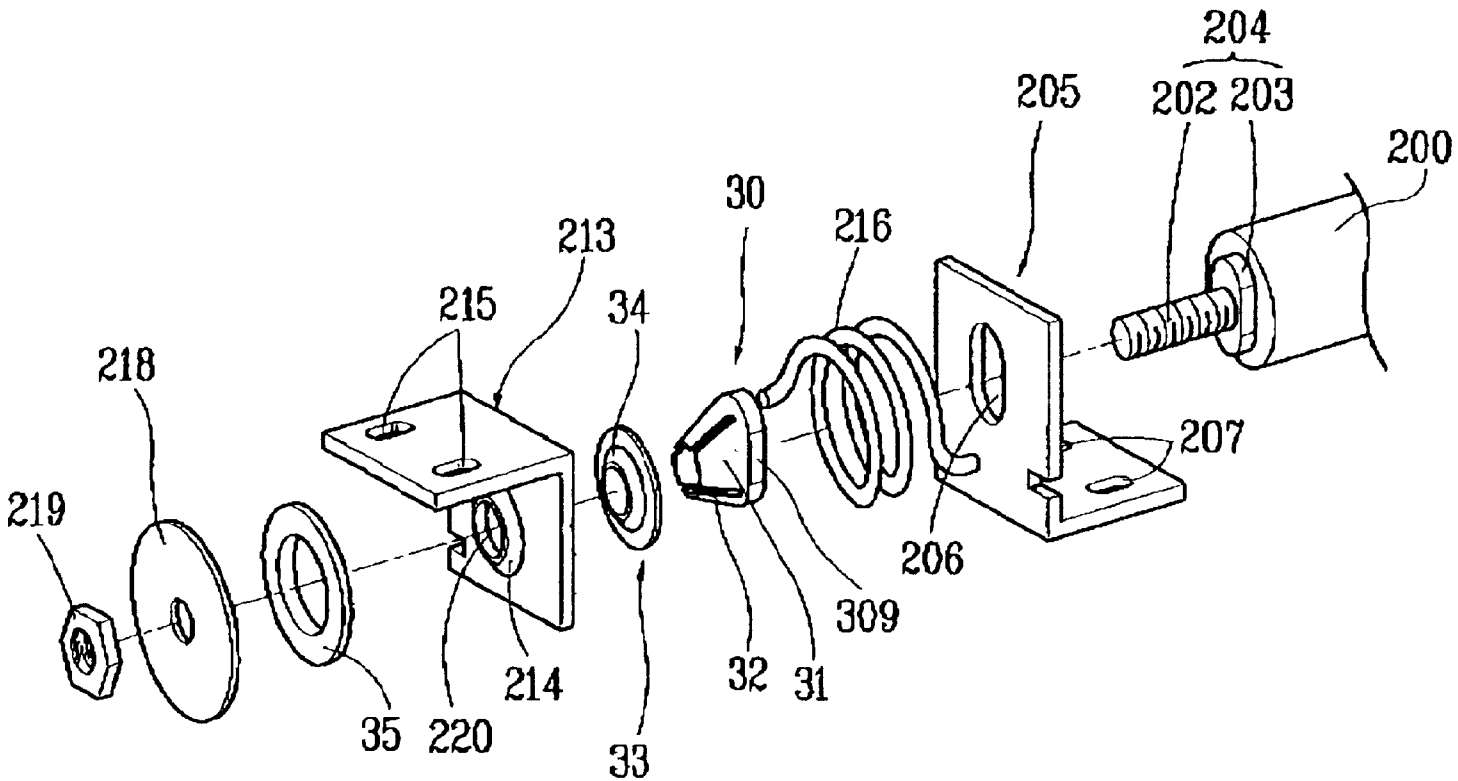
FIG. 5 illustrates a perspective partial assembly view of a hinge assembly in accordance with a second preferred embodiment of the present invention; and, FIG. 6 illustrates a section of key parts of the hinge assembly in FIG. 5.

In the meantime, a second embodiment of the present invention will be explained with reference to the attached drawings, in which a shape of the frictional elastic member in the first embodiment is modified to be simpler, and an adjusting washer is provided additionally between the rotating bracket and the frictional elastic member, for serving as a buffer in case the frictional elastic member is compressed excessively, and adjusting the torque between the rotating bracket and the frictional elastic member. FIG. 5 illustrates a perspective partial assembly view of a hinge assembly in accordance with a second preferred embodiment of the present invention, and FIG. 6 illustrates a section of key parts of the hinge assembly in FIG. 5.

Figure 6:
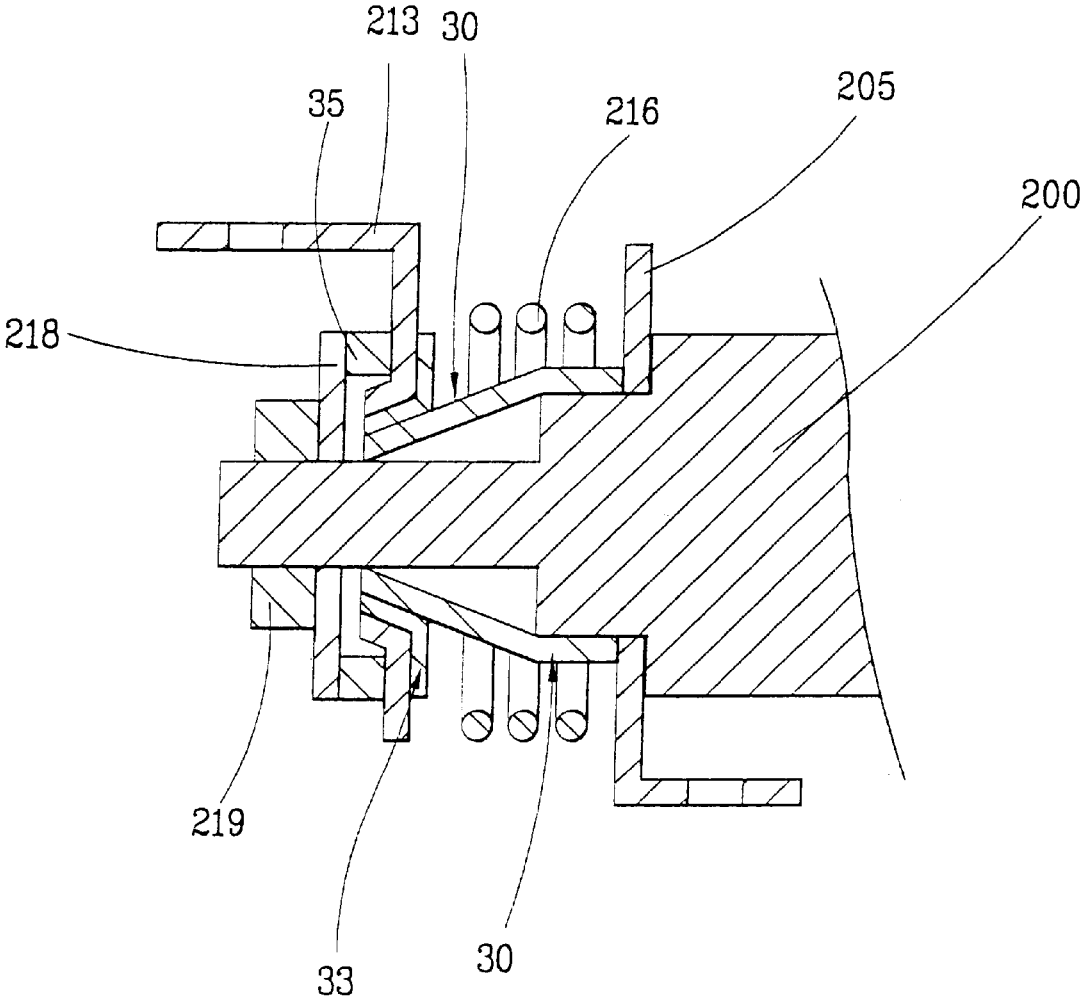

Referring to FIGS. 5 and 6, the hinge assembly in accordance with a second preferred embodiment of the present invention has components identical to the first embodiment except the frictional elastic member 30 and the adjusting washer 33. The second embodiment may also have a supplementary torsion spring 216.

Like the first embodiment, the second embodiment of the hinge assembly includes a fixed bracket 205 coupled to a two-stepped cylindrical coupling part 204 of different diameters on each shaft 200, and a frictional elastic member 30 coupled next to the fixed bracket 205. Like the first embodiment, the frictional elastic member 30, opened in the front and rear direction, is made to receive a coupling part 204, and a bottom part 309 of the frictional elastic member 30 is formed to fit to the lower step 203 of the coupling part 204. The frictional elastic member 30 has a sloped surface part 31 extended from the bottom part having a diameter that decreases continuously as it goes upward, and longitudinal grooves 32 formed from an end of the sloped surface part 31 for efficient adjustment of the shrinkage of the frictional elastic member 30.

The frictional elastic member 30 works the same as the frictional elastic member 208 in the first embodiment. However, different from the first embodiment, the second embodiment frictional elastic member 30 has no cylindrical top part to be inserted in the coupling hole 220 in the rotating bracket 213, but, instead, an adjustment washer 33 between the rotating bracket and the frictional elastic member, additionally. The rotating bracket is identical to the rotating bracket 213 in the first embodiment. The adjustment washer 33 has a sloped surface 34 around a hole projected in a same direction with the frictional elastic member 30 for making close contact with the sloped surface part 31 of the frictional elastic member 30 in one side, and with a taper part 214 around the coupling hole 220 in the rotating bracket 213. The adjustment washer 33 buffers compression onto the rotating bracket 213 applied for increasing torque to the rotating bracket 213 for preventing the frictional elastic member from being broken by the compression, and enables fine tuning of the torque between the frictional elastic member 30 and the rotating bracket 213. That is, the adjustment washer 33 is made thin compared to general washers for placing an increased number of washers between the rotating bracket 213 and the frictional elastic member 30 when the torque required from the rotating bracket 213 is not adequate, and for placing a decreased number of washers between the rotating bracket 213 and the frictional elastic member 30 when the torque required from the rotating bracket 213 is excessive. However, the adjustment washer 33 is not essential, but may be dispensed with if the torque provided by the frictional elastic member 30 alone is adequate. However, since performance of the frictional elastic member 30 can degrade in a prolonged use of the hinge assembly, the provision of the adjustment washer 33 will permit a longer lifetime thereof.

In the meantime, there is a washer 35 between the rotating bracket 213 and the anti-loose nut 219, like the thick washer 217 in the first embodiment, for protecting the taper part 214 around the coupling hole 220 of the rotating bracket 213 from breakage when the taper part 214 is pressed by the anti-loose nut 219. The anti-loose nut 219 works the same as in the first embodiment.

Works of the embodiment of the present invention will be explained.

Upon rotation of the anti-loose nut on an outside of the hinge assembly, the rotating bracket is pushed to compress the sloped surface part of the frictional elastic member onto an inside of the coupling hole of the rotating bracket, to provide an elastic force to the rotating bracket in turn and a torque to the rotating bracket when the rotating bracket is rotated by friction occurred. According to the above work, the torque provided to the rotating bracket differs depending on a number of rotations of the anti-loose nut, i.e., an extent of fastening.

As has been explained, the provision of a required torque in a hinge only by means of a sloped frictional elastic member enable the number of required components to be reduced, and provides a simple hinge structure, thereby enhancing a production efficiency of the hinge, reducing a production cost of the hinge, and allowing for more precise torque and re-setting of the torque.

It will be apparent to those skilled in the art that various modifications and variations can be made in the hinge assembly of the present invention without departing from the spirit or scope of the invention. Thus, it is intended that the present invention cover the modifications and variations of this invention provided they come within the scope of the appended claims and their equivalents.

What is claimed is:

1. A hinge assembly provided between a fixed body to be coupled to a fixed object and a rotating body to be coupled to a rotating object to be rotatably fitted to the fixed object, for providing a torque required with respect to the fixed object, the hinge assembly comprising:

a shaft;

a fixed bracket having one leaf fixed to an end of the shaft, and the other leaf fixed to the fixed body;

a rotating bracket having a first leaf rotatably coupled to the shaft from an outer side of the fixed bracket and having a tapered hole part therethrough, and a second leaf coupled to the rotating body, said tapered hole part projected outward such that a diameter of said tapered hole part is larger on a side of said first leaf facing said fixed bracket; and, a frictional elastic member disposed between the fixed bracket and the rotating bracket such that a bottom end part thereof is fixed to an end of the shaft, and the other end thereof is coupled to the rotating bracket to pass through the rotating bracket, for making friction as a part of the frictional elastic member in contact with the rotating bracket makes an elastic compression onto the rotating bracket, for applying a torque to the rotating bracket.

2. The hinge assembly as claimed in claim 1, further comprising a torsion spring, between the rotating bracket and the fixed bracket and around the frictional elastic member, having one end coupled to the fixed bracket and the other end coupled to the rotating bracket.

3. The hinge assembly as claimed in claim 1, wherein the frictional elastic member has a sloped surface part adjacent said bottom end part and having a slope cooperating with the tapered hole part of said first leaf for pass-through coupling with the rotating bracket, such that the sloped surface part of the frictional elastic member passes through and is in close contact with the tapered hole part.

4. The hinge assembly as claimed in claim 3, further comprising a washer between the sloped surface part of the frictional elastic member and the tapered hole part of the rotating bracket for close contact both with the sloped surface part and the tapered hole part.

5. The hinge assembly as claimed in claim 1, wherein the frictional elastic member has a plurality of grooves started from an end thereof that passes through the hole in the rotating bracket, said bottom end part being ungrooved.

6. The hinge assembly as claimed in claim 3, wherein the frictional elastic member has a plurality of grooves started from an end of said sloped surface part to easily pass through the hole in the rotating bracket, said bottom end part being ungrooved.

7. The hinge assembly as claimed in claim 3, wherein the frictional elastic member has grooves in a surface thereof for smooth shrinkage.

8. The hinge assembly as claimed in claim 4, wherein the frictional elastic member has grooves in a surface thereof for smooth shrinkage.

9. The hinge assembly as claimed in claim 1, further comprising a washer fitted to an outer side of the rotating bracket for surrounding a part of the frictional elastic member passed through and coupled with the rotating bracket, for protecting said part.

10. The hinge assembly as claimed in claim 1, wherein the shaft has an oval or polygonal stepped coupling part at an end thereof, and the fixed bracket and the frictional elastic member have a coupling hole and said bottom end part, respectively, form fit to receive the coupling part which is inserted in the coupling hole and the bottom end part.

11. The hinge assembly as claimed in claim 1, wherein the shaft has a thread at an end thereof, and an anti-loose nut fastened to the thread from an outer side of the rotating bracket for pressing the rotating bracket, the frictional elastic member, and the fixed bracket onto an end of the shaft.

12. The hinge assembly as claimed in claim 1, wherein the fixed object is a monitor support and the rotating object is a flat monitor.

13. A hinge assembly provided between a fixed body to be coupled to a fixed object and a rotating body to be coupled to a rotating object to be rotatably fitted to the fixed object, for providing a torque required with respect to the fixed object, the hinge assembly comprising:

a shaft;

a fixed bracket having one leaf fixed to an end of the shaft, and the other leaf fixed to the fixed body;

a rotating bracket having one leaf rotatably coupled to the shaft from an outer side of the fixed bracket, and the other leaf coupled to the rotating body;

a frictional elastic member disposed between the fixed bracket and the rotating bracket such that one end thereof is fixed to an end of the shaft, and the other end thereof is coupled to the rotating bracket to pass through the rotating bracket, for generating friction as a part of the frictional elastic member in contact with the rotating bracket makes an elastic compression onto the rotating bracket, for applying a torque to the rotating bracket; and a torsion spring provided around said frictional elastic member, said spring having one end coupled to the fixed bracket and the other end coupled to the rotating bracket.

14. The hinge assembly as claimed in claim 13, wherein the frictional elastic member has a sloped surface part for pass-through coupling with the rotating bracket, and the rotating bracket has a taper part projected outward in a hole part thereof such that the sloped surface part of the frictional elastic member passes through and is in close contact with said taper part.

15. The hinge assembly as claimed in claim 14, further comprising a washer between the sloped surface part of the frictional elastic member and the taper part of the rotating bracket for close contact both with the sloped surface part and the taper part.

16. The hinge assembly as claimed in claim 13, wherein the frictional elastic member has a plurality of grooves started from an end thereof that passes through the hole in the rotating bracket.

17. The hinge assembly as claimed in claim 14, wherein the frictional elastic member has a plurality of grooves started from an end of said sloped surface part that passes through the hole in the rotating bracket.

18. The hinge assembly as claimed in claim 14, wherein the frictional elastic member has grooves on a surface thereof for smooth shrinkage.

19. The hinge assembly as claimed in claim 15, wherein the frictional elastic member has grooves on a surface thereof for smooth shrinkage.

20. The hinge assembly as claimed in claim 13, wherein the frictional elastic member has grooves on a surface thereof for smooth shrinkage.

21. The hinge assembly as claimed in claim 13, further comprising a washer fitted to an outer side of the rotating bracket for surrounding a part of the frictional elastic member passed through and coupled with the rotating bracket, for protecting said part of the frictional elastic member.

22. The hinge assembly as claimed in claim 13, wherein the shaft has an oval or polygonal coupling part at an end thereof, and the fixed bracket and the frictional elastic member have a coupling hole and a bottom part, respectively, said coupling part being inserted into said coupling hole and said bottom part so that said fixed bracket and said frictional elastic member rotate together with said shaft.

23. The hinge assembly as claimed in claim 13, wherein the shaft has a thread at an end thereof, and an anti-loose nut fastened to the thread from an outer side of the rotating bracket for pressing the rotating bracket, the frictional elastic member, and the fixed bracket onto an end of the shaft.

24. The hinge assembly as claimed in claim 13, wherein the fixed object is a monitor support and the rotating object is a flat monitor.

* * * * *